United States Patent [19]

Shirosaki et al.

[11] Patent Number: 5,000,915

[45] Date of Patent: Mar. 19, 1991

[54] WEAR-RESISTANT COPPER ALLOY

[75] Inventors: Takehiro Shirosaki, Fujisawa; Takashi Kikkawa, Isehara; Hirotaka Toshima, Fujisawa, all of Japan

[73] Assignee: Oiles Corporation, Tokyo, Japan

[21] Appl. No.: 370,268

[22] Filed: Jun. 22, 1989

[51] Int. Cl.[5] ..... C22C 9/04; C22C 9/01

[52] U.S. Cl. ..... 420/479; 420/478; 420/580

[58] Field of Search ..... 420/478, 479, 480, 580, 420/471

[56] References Cited

U.S. PATENT DOCUMENTS

| | | | |
|---|---|---|---|
| 3,773,504 | 11/1973 | Niimi et al. | 420/480 |
| 4,750,953 | 6/1988 | Tabei | 420/479 |

FOREIGN PATENT DOCUMENTS

| | | | |
|---|---|---|---|
| 706826 | 3/1965 | Canada | 420/478 |
| 4320917 | 5/1968 | Japan . | |
| 52-005445 | 2/1977 | Japan | 420/480 |
| 59-116347 | 7/1984 | Japan | 420/478 |
| 59-145744 | 8/1984 | Japan | 420/479 |

*Primary Examiner*—Richard O. Dean
*Assistant Examiner*—Margery S. Phipps
*Attorney, Agent, or Firm*—David G. Conlin; Ernest V. Linek

[57] ABSTRACT

Disclosed herein is a wear-resistance alloy consisting essentially of about 10 to 40 wt % of Zn, about 3 to 10 wt % of Al, about 0.1 to 4 wt % of Cr, and optionally not more than about 8 wt % of Mn and not more than about 2 wt % of Ni, with the balance, Cu.

1 Claim, No Drawings

WEAR-RESISTANT COPPER ALLOY

BACKGROUND OF THE INVENTION

The present invention relates to a wear-resistance copper alloy for a sliding member such as a bearing and a sliding plate and, more particularly, to a wear-resistance copper alloy which exhibits excellent friction and wear properties under low-speed and high-load conditions.

The following copper alloys have conventionally been proposed: a wear-resistance copper alloy having improved wear-resistance and mechanical strength so as to be usable under high-speed and high-load conditions, produced by adding not more than 1.0 wt % in total of at least one selected from the group consisting of Cr, Ti, V and Zr to an alloy containing 55 to 67 wt % of Cu, 1.0 to 6.0 wt % of Mn, 0.1 to 1.2 wt % of Si, 0.1 to 6 wt % of Al, 0.1 to 3.0 wt % of Pb and the balance Zn [Japanese Patent Publication No. 44-28789 (1969)]; a wear-resistance copper alloy having an improved wear-resistance at a high temperature, produced by adding not more than 10 wt % in total of at least one selected from the group consisting of Mn, Cr, Bi to an alloy containing 60 to 85 wt % of Cu, 6 to 13 wt % of Al, 3 to 20 wt % of Ni, 1 to 10 wt % of Co as the main ingredients [Japanese Patent Application Laid-Open No. 49-66527 (1974)]; a copper alloy for a valve seat with excellent anti-seizing property and wear-resistance at a high temperature, comprising 25 to 40% of Zn, 1 to 8% of Al, 1 to 5% of Mg, 0.3 to 2% of Si, 0.8 to 3% of Cr, 0.3 to 1% of P, not more than 5% of impurity elements and the balance Cu [Japanese Patent Publication No. 50-7010 (1975)]; a wear-resistance aluminum bronze for a sliding member having excellent cohesive wear-resistance and anti-seizing property, characterized in that the amount of iron silicate dispersed in the Cu-Al alloy is not smaller than the eutectic composition in the quasibinary phase diagram of a Cu-Al phase and an iron silicate phase [Japanese Patent Application Laid-Open No. 51-133127 (1976)]; and an age-hardening copper alloy for a bearing or a gear of a clock, which comprises 5 to 35% of Zn, 1 to 20% of Ni, more than 1 and not more than 8% of Al and the balance substantially Cu, wherein an intermetallic compound of Ni, and Al is mainly separated out by heat-treatment [Japanese Patent Publication No. 52-50724 (1977)].

As a copper alloy for a sliding member used under low-speed and high-load conditions, a high-strength brass alloy regulated by JIS H 5102, which comprises not less than 60.0 wt % of Cu, 2.5 to 5.0 wt % of Mn, 2.0 to 4.0 wt % of Fe, 5.0 to 7.5 wt % of Al, not more than 0.2 wt % of Sn and the balance Zn, and a brass alloy regulated by ASTM B22 C 86300, which comprises 60 to 66 wt % of Cu, 22 to 28 wt % of Zn, 5 to 7.5 wt % of Al, 2.5 to 5 wt % of Mn, 2 to 4 wt % of Fe, 1.0 wt % of Ni, not more than 0.2 wt % of Sn and not more than 0.2 wt % of Pb are known.

Such a copper alloy is used for a sliding member by supplying a lubricating oil such as grease and oil to the sliding surface, or burying a solid lubricant such as graphite and molybdenum disulfide in the sliding surface or covering the sliding surface therewith.

The sliding member made of such a high-strength brass alloy is provided with a sufficient mechanical strength as a sliding member but cannot be said to have sufficient friction and wear properties. Particularly, the wear-resistance is disadvantageously lowered when the sliding member is used for a long time.

As a result of investigation and experiments of each of the ingredients of a high-strength brass alloy as a sliding material with a view to solving the above-described problem, the present inventors have found that the amount of Fe added has a great influence on the wear-resistance.

That is, in the case where the amount of Fe added is small, the wear-resistance is improved, while a further increase in the amount of Fe added reduces the wear-resistance.

Reduction in the amount of Fe added, however, impairs a fine alloy structure and lowers the mechanical strength of the alloy, which makes it difficult to use the alloy for a sliding member.

As a result of studies undertaken by the present inventors so as to achieve an object of providing a copper alloy which is capable of improving the wear-resistance without impairing the mechanical strength of the sliding member of a conventional high-strength brass alloy, it has been found that a copper alloy obtained by adding Cr to a composition of a conventional high-strength brass alloy in place of Fe, exhibits an excellent wear-resistance, especially, under low-speed and high-load conditions without impairing the mechanical strength as a sliding member. The present invention has been achieved on the basis of this finding.

SUMMARY OF THE INVENTION

In a first aspect of the present invention, there is provided a wear-resistance alloy comprising 10 to 40 wt % of Zn, 3 to 10 wt % of Al, 0.1 to 4 wt % of Cr and the balance Cu.

In a second aspect of the present invention, there is provided a wear-resistance alloy comprising 10 to 40 wt % of Zn, 3 to 10 wt % of Al, 0.1 to 4 wt % of Cr, not more than 8 wt % of Mn, not more than 2 wt % of Ni and the balance Cu.

DETAILED DESCRIPTION OF THE INVENTION

Cu is a main ingredient of a copper alloy of the present invention and contributes to excellent thermal conductivity and corrosion resistance. When Cu is reacted with oxygen in air, a copper oxide thin film is formed on the surface thereof and the thus formed thin film is self-lubricating and contributes to a wear-resistance of the alloy. The Cu content is the balance determined by the content of Zn, Al, Cr, Mn and Ni.

Zn is also a main ingredient of a copper alloy of the present invention, forms a solid solution together with Cu to enhance the strength of the alloy, deoxidizes the molten metal during melting, and improves the casting properties. However, if the Zn content is not less than 40 wt %, the alloy becomes brittle and deteriorates the machining property. On the other hand, if the Zn content is not more than 10 wt %, the effect of adding Zn is insufficient. Therefore, the preferred amount of Zn added is 10 to 40 wt %, and when it is 20 to 30 wt %, the greatest effect is exhibited.

Al contributes to the mechanical properties, in particular, the strength and the hardness. The preferred amount of Al added is 3 to 10 wt % in consideration of the casting properties and machine-working property of the alloy and, especially, when it is 5 to 8 wt %, the greatest effect is exhibited.

Cr is an element useful for effectuating a finer structure, increasing the strength and forming an oxide film. Addition of not less than 4% of Cr, however, is apt to deteriorate the machining property and the casting properties. On the other hand, addition of not more than 0.1 wt % of Cr does not fully display the effect of addition. Therefore, the preferred amount of Cr added is 0.1 to 4 wt % and, especially, when it is 0.5 to 2.5 wt %, the greatest effect is exhibited.

Mn is an element added to an alloy composed of Zn, Al, Cr and the balance Cu in order to increase the mechanical properties of the alloy. If the amount of Mn added is not less than 8 wt %, the elongation of the alloy is apt to be greatly reduced, so that the amount of Mn added is preferably not more than 8 wt %.

Ni is an element added to an alloy composed of Zn, Al, Cr and the balance Cu in order to increase the mechanical properties of the alloy as Mn. However, if too large an amount of Ni is added, the wear-resistance is apt to be rather deteriorated, so that the preferred amount of Ni added is not more than 2 wt %.

A known method can be adopted for producing a copper alloy of the present invention.

The wear-resistance copper alloy of the present invention comprising 10 to 40 wt % of Zn, 3 to 10 wt % of Al, 0.1 to 4 wt % of Cr and the balance Cu, or further not more than 8 wt % of Mn and not more than 2 wt % of Ni added thereto, if necessary, exhibits an excellent wear-resistance as a copper alloy for a sliding member which is used under low-speed and high-load conditions, e.g., at a speed of not more than 3m/min and a contact pressure of not less than 250 Kgf/cm$^2$.

The present invention will be explained hereinunder with reference to the following non-limitative examples.

EXAMPLE 1

Cu was melted in a graphite crucible at 1,200° C., and Zn, Al and Cu-10% Cr mother alloy were added to the molten metal and melted so that the alloy had a predetermined composition. The molten metal was poured into a mold while maintaining the temperature thereof at 1,200° C.

EXAMPLE 2

Cu was melted in a graphite crucible at 1,200° C., and Zn, Al, Cu-10% Cr mother alloy, Cu-25% Mn mother alloy and Cu-30% Ni mother alloy were added to the molten metal and melted so that the alloy had a predetermined composition. The molten metal was poured into a mold while maintaining the temperature thereof at 1,200° C.

The following table shows the composition, the friction and wear properties and the mechanical properties of the copper alloy obtained in each example.

The friction and wear properties and the mechanical properties were represented by the values obtained from the tests carried out under the following conditions.

Dimension of a test piece:
- inner diameter: 60 mm, outer diameter: 75 mm
- length: 40 mm Mating material (shaft): Structural carbon steel plated with hard chromium
- Sliding speed: 0.5 m/min
- Load: 18,000 kgf (reciprocal oscillation motion journal load)
- Oscillation angle: ±45° C.
- Total sliding distance: 2,820 m Lubrication: 40 graphite solid lubricants 8 mm in diameter were embeded in the sliding surface such as to overlap with each other in the sliding direction and thereafter it was soaked with lubricating oil by oil-impregnation treatment. (27% of a solid lubricant was exposed to the sliding surface).

(1) Specific depth of wear

The depth of wear was calculated from the difference between the dimension before the test and the dimension after the test.

$$\text{Specific depth of wear (mm/m)} = \frac{\text{Depth of wear (mm)}}{\text{Total sliding distance (m)}}$$

(2) Friction coefficient

The torque (T) of the mating material was measured by using TORQUE METER (TM/200B, manufactured by SHINKOH COMMUNICATION INDUSTRY CO., LTD). The friction coefficient ($\mu$) was calculated by the following formulae.

$$F = \frac{T}{\gamma} \text{ and } \mu = \frac{F}{W}$$

(wherein F represents friction force, T represent torque, $\gamma$-represents inner radius of the test peace of the mating material and W represents load)

(3) Tensile strength

Measured in accordance with JIS - Z 2241

(4) Brinell Hardness

Measured in accordance with JIS - Z 2243

In Comparative Example, high-strength brass alloys according to JIS H 5102 were tested under the same conditions as above.

From the results of the tests, it is observed that the copper alloys of the present invention, namely, samples Nos. 1, 2, 3 and 4 have greatly improved wear-resistance in comparison with the samples in Comparative Example.

The reason why the wear resistance is greatly improved is not clear but it is inferred from the fact that hard $\gamma$-phases were scattered in the $\beta$-phase when the structure of a copper alloy of the present invention was observed, that the $\gamma$-phases contribute to the wear-resistance.

The structure of the high-strength brass alloy in Comparative Example had $\beta$-phase.

| | Sample No. | Composition (wt %) | | | | | | | | Specific depth of wear ($\times 10^{-6}$ mm/m) | Friction coefficient | Tensile strength (Kgf/cm$^2$) | Brinell Hardness |
|---|---|---|---|---|---|---|---|---|---|---|---|---|---|
| | | Cu | Zn | Al | Cr | Mn | Ni | Fe | Sn | | | | |
| Example 1 | 1 | Balance | 26.7 | 6.2 | 0.8 | — | — | — | — | 3.63 | 0.08 | 78 | 231 |
| | 2 | Balance | 25.4 | 6.2 | 1.9 | — | — | — | — | 3.70 | 0.08 | 78 | 235 |
| Example 2 | 3 | Balance | 27.3 | 6.2 | 0.9 | 3.0 | 1.6 | — | — | 3.90 | 0.09 | 79 | 241 |

-continued

| | Sample No. | Composition (wt %) Cu | Zn | Al | Cr | Mn | Ni | Fe | Sn | Specific depth of wear ($\times 10^{-6}$ mm/m) | Friction coefficient | Tensile strength (Kgf/cm$^2$) | Brinell Hardness |
|---|---|---|---|---|---|---|---|---|---|---|---|---|---|
| | 4 | Balance | 24.0 | 6.1 | 4.0 | 3.1 | 1.5 | — | — | 4.12 | 0.09 | 83 | 241 |
| Comparative Example | 1 | Balance | 25.3 | 5.9 | — | 3.3 | — | 2.7 | 0.02 | 21.99 | 0.12 | 80 | 201 |
| | 2 | Balance | 22.4 | 6.5 | — | 3.1 | 1.0 | 3.7 | — | 18.10 | 0.10 | 84 | 243 |
| | 3 | Balance | 25.8 | 5.3 | — | 3.4 | — | 2.7 | — | 19.21 | 0.10 | 78 | 193 |

What is claimed is:

1. A wear-resistance alloy consisting essentially of from 10 to 40 wt % of Zn, 3 to 10 wt % of Al, 0.1 to 4 wt % of Cr, 3.0 to 8 wt % of Mn, 1.5 to 2 wt % of Ni, with the balance Cu.

* * * * *